US005797650A

United States Patent [19]

Gonzalez, Jr. et al.

[11] Patent Number: 5,797,650

[45] Date of Patent: Aug. 25, 1998

[54] SUN SHADE ATTACHMENT

[76] Inventors: Ralph Gonzalez, Jr.; Alessandra Pili-Gonzalez, both of 120-31G Benchley Pl., Bronx, N.Y. 10475

[21] Appl. No.: 915,459

[22] Filed: Aug. 20, 1997

[51] Int. Cl.[6] ..... A47C 31/00

[52] U.S. Cl. ..... 297/184.1; 297/188.06

[58] Field of Search ..... 297/184.1, 184.15, 297/188.06, 188.2; 160/31, 36, 239; 135/96, 88.1, 88.12, 117, 119; 403/205, 403

[56] References Cited

U.S. PATENT DOCUMENTS

| | | | |
|---|---|---|---|
| 900,572 | 10/1908 | Morton | 297/184.15 |
| 1,180,124 | 4/1916 | Foedisch et al. | 160/31 |
| 3,404,915 | 10/1968 | De Souza Filho | 297/184.1 X |
| 4,643,479 | 2/1987 | Servi | 297/184.15 |
| 5,096,257 | 3/1992 | Clark | 297/184.15 |
| 5,174,073 | 12/1992 | Sabo | 135/88.11 X |
| 5,203,363 | 4/1993 | Kidwell et al. | 297/184.15 X |
| 5,561,870 | 10/1996 | Hertel | 403/205 X |
| 5,579,797 | 12/1996 | Rogers | 135/96 X |

*Primary Examiner*—Peter R. Brown
*Assistant Examiner*—Stephen Vu
*Attorney, Agent, or Firm*—Goldstein & Associates

[57] ABSTRACT

A sun shade for attaching to a chair and providing shade to an individual seated in the chair. The sun shade comprises a rigid horizontal cross member having telescoping vertical arm assemblies slideably and pivotally secured to each end. The telescoping vertical arm assemblies have splint assemblies affixed at the lower end, the splint assemblies capable of engaging a chair. A rotating shade pin is in communication with the horizontal cross member and has a shade screen secured to it. A pair of shade screen rails frame the edges of the shade screen.

3 Claims, 2 Drawing Sheets

SUN SHADE ATTACHMENT

BACKGROUND OF THE INVENTION

The invention relates to a sun shade attachment. More particularly, the invention relates to a sun shade which attaches onto a standard beach chair, and then selectively blocks the sun's rays from reaching a person seated in the chair.

People enjoy lying on the sun at the beach. Sunbathing can be relaxing and can enhance one's appearance. However, while lying on the beach, many people find it undesirable to have the sun shine directly on their face. The hot sun can be irritating to sensitive facial skin, and over-exposure can lead to various skin conditions. In addition, over-exposure of the suns rays can lead to premature facial aging.

Furthermore, people often bring young children to the beach. Children are especially sensitive to the sun. A baby's young skin cannot tolerate the sun for too long.

People have sought to selectively block the suns rays using umbrellas which either attach to their chair, or stick in the ground. However, it is difficult use an umbrella to selectively block the sun from portions of the body, such as the face, while allowing the suns rays to reach the remainder of the body.

Other's have proposed systems which attach onto pre-existing beach chairs. While attaching onto a beach chair is perhaps the best answer, these units have failed in providing an effective solution.

U.S. Pat. No. 5,096,257 to Clark discloses a sunshade apparatus for a chair. Clark attaches onto a chair with large C-clamps which require a flat transverse bar on the chair in order to attach properly. Unfortunately, standard beach chairs are made of tubular aluminum or plastic—there is no handy flat transverse bar to attach onto. Thus Clark will not work with standard beach chairs.

U.S. Pat. No. 5,135,281 to Pappalardo discloses a sunshade which attaches onto a chair frame with straps, and is also supported in part by guy-wire like strings.

U.S. Pat. No. 5,320,405 to Foster et al. discloses a portable sunshade using sleeve means for removable attachment to the back of a lounge chair. Foster et al. employs a plurality of U-shaped bales, which are joined together at each end by a joint. A fabric web ensheathes the bails and creates a shade providing canopy when the bails are spread apart from each other in a fan-like fashion.

While these units may be suitable for the particular purpose employed, or for general use, they would not be as suitable for the purposes of the present invention as disclosed hereafter.

SUMMARY OF THE INVENTION

It is an object of the invention to produce a sun shade that is easily attachable onto a beach chair, for effectively blocking the sun's rays to a person seated in the chair.

It is another object of the invention to provide a sun shade that is capable of attaching onto a wide variety of beach chairs, of different sizes and varieties.

It is a further object of the invention that the sun shade laterally telescopes, to adjust to chairs of differing widths.

It is a still further object of the invention that the components of the sun shade are collapsible, to allow easy storage of the sun shade when not in use.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
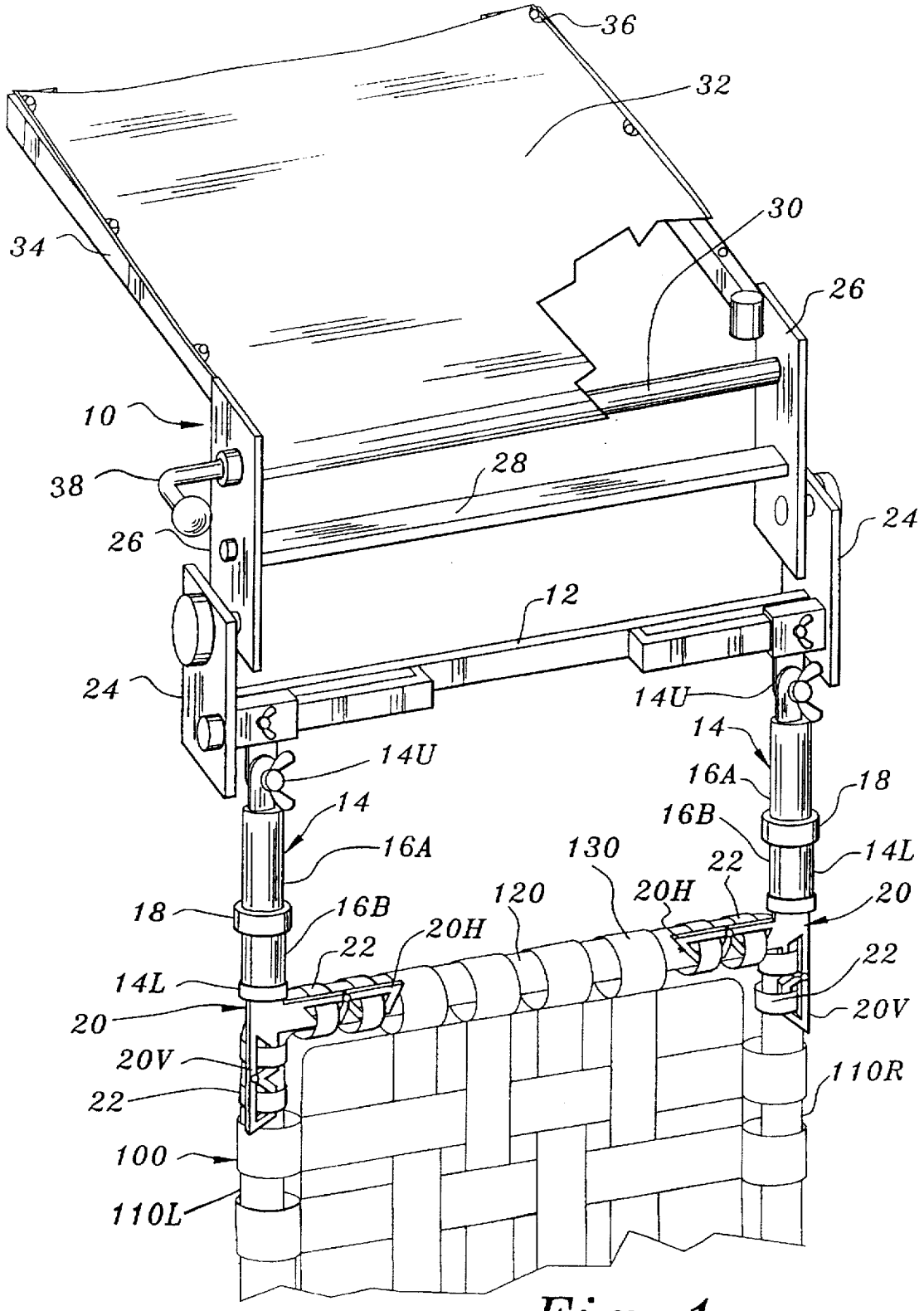
FIG. 1 is a diagrammatic perspective view of the sun shade, installed on a typical beach chair.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the sun shade. The words "proximal end" and "distal end" refer, respectively, to ends of an object nearer to and further from the operator of the object when the object is used in a normal fashion or as is described in the specification.

FIG. 1 illustrates a sun shade 10 installed upon a chair 100, such as a standard beach or lounge chair. As illustrated in FIG. 1, the chair 100 comprises a left vertical member 110L, right vertical member 110R, and horizontal member 120 which extends between said left vertical member 110L and right vertical member 110R. Fabric weaving 130 is shown interlaced between said vertical members 110 and the horizontal member 120.

The sun shade 10 comprises a rigid main horizontal cross-member 12 having a left end 12L and opposite right end 12R. The horizontal cross-member 12 has a pair of telescoping vertical arm assemblies 14, each of said vertical arm assemblies 14 slideably secured to and extending from each of said cross-member end 12L and 12R. Each telescoping vertical arm assembly 14 has an upper end 14U and a lower end 14L located opposite therefrom, the upper end 14U pivotally secured to the horizontal cross-member 12. In addition, each telescoping vertical arm assembly 14 comprises an outer tube 16A having a smaller diameter inner tube 16B extending therein. A height adjustment ring 18 couples the outer tube 16A and inner tube 16B, and permits the length of each telescoping vertical arm assembly 14 to be adjusted by varying the length of the inner tube 16B which is contained within the outer tube 16A. It should be appreciated that numerous other means for creating telescoping assemblies are well known in the art and also contemplated for the instant invention.

A splint assembly 20 is secured at the lower end 14L of each telescoping vertical arm assembly 14. Each splint assembly 20 further comprises a vertical splint member 20V and a horizontal splint member 20H, said splint members extending essentially perpendicular to each other. Both the horizontal splint members 20H and vertical splint members 20V possess splint securing means 22 such as detachable hook and loop fasteners or clamps which are capable of engaging respectively the horizontal member 120 and vertical members 110 of the chair 100.

In order to secure the sun shade 10 to the chair 100, the telescoping vertical arm assemblies 14 are positioned along the horizontal cross member 12 to which they are slideably engaged so that one assembly is aligned with the left vertical member 110L of the chair 100, and the other telescoping vertical arm assembly 14 aligned with the right vertical member 1OR of the chair 100, as seen in FIG. 1. The vertical splints 20V of each splint assembly 20 are then secured, via the splint securing means 22 to each vertical member 110 of the chair 100, as also seen in FIG. 1. The height of the horizontal cross-member 12 of the sun shade 10, and hence the height of the entire sun shade 10, is adjusted by loosening the height adjustment rings 18 of the telescoping vertical arm assemblies 14 and varying the length of the inner tube 16B which is contained within the outer ==tube 16A thereof.

The horizontal cross-member 12 of the sun shade 10 has a first side plate 24 extending upward from the left end 12L and right end 12R. Each first side plate 24 extends upward and is secured to a second side plate 26. A stabilizing bracket 28 extends between and is secured to the pair of second side plates 26, as seen in FIG. 1. A rotating shade pin 30 is also rotatably secured between said second side plates 26. A shade screen 32 is secured to the rotating shade pin 30, capable of extending fully outward therefrom as seen in FIG. 1, or of being retracted and wound about said rotating shade pin as seen in FIG. 2.

Figure 2:
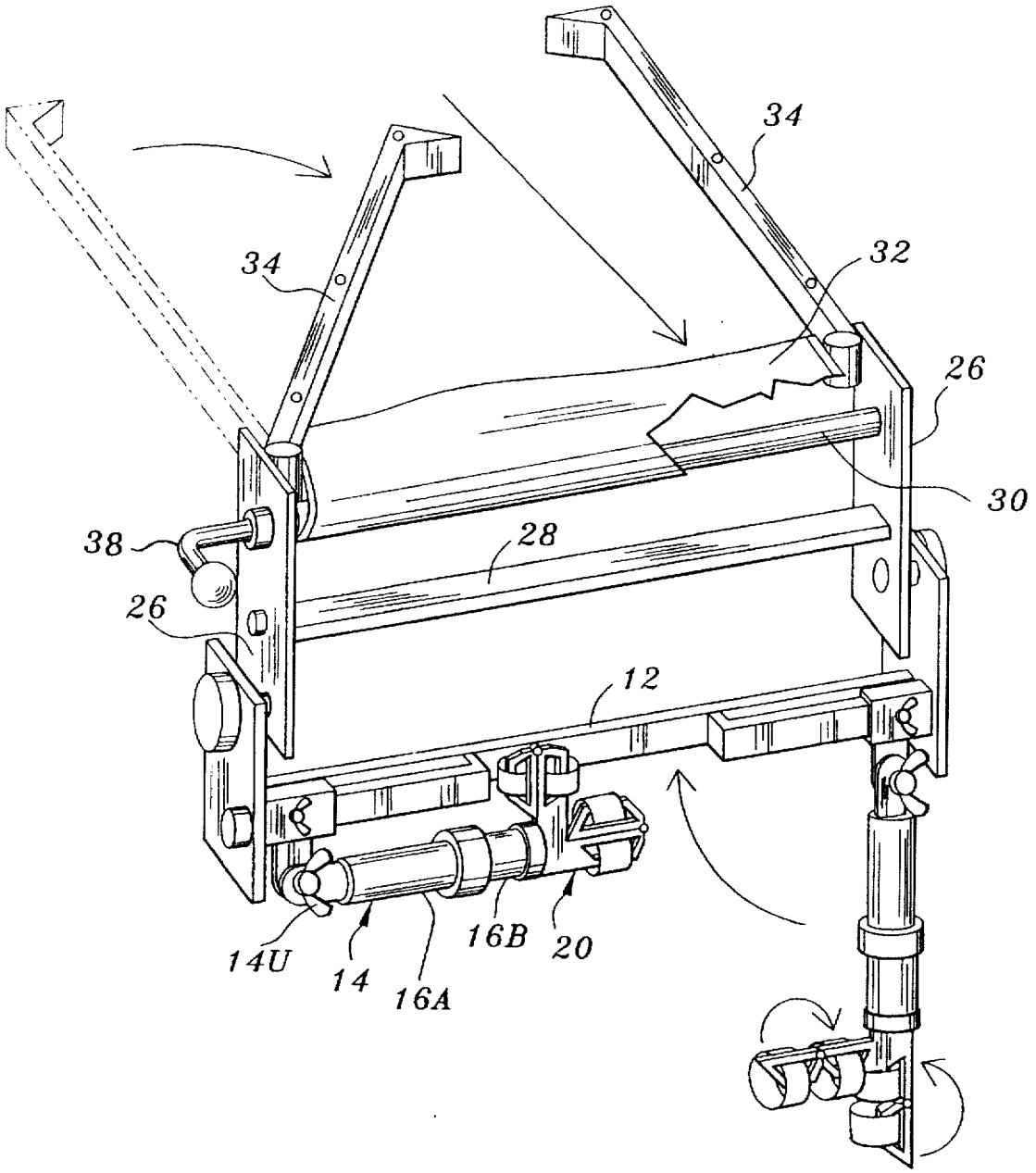
FIG. 2 is a diagrammatic perspective view of the sun shade after it has been detached from the beach chair, and wherein the various components thereof are being retracted for storage.

A shade screen rail 34 extends outward from each second side plate 26, in the manner illustrated in FIGS. 1 and 2. Said shade screen rails 34 are secured pivotally to the second side plates 26, so that during times of non-use, they may be folded inward toward the rotating shade pin 30, as seen in FIG. 2, to "collapse" the sun shade 10. When the shade screen rails 34 are in the outward position seen in FIG. 1, they extend essentially parallel to the horizon, so that the shade screen 32 may be extended therebetween also parallel to the horizon, thus providing shade to a person located thereunder. In addition, the shade screen 32 has fasteners 36 disposed along its periphery which enable said shade screen 32 to be secured at various points along the length of the shade screen rails 34. A pin handle 38 located on the outer side of one of the second side plates 26 extends therethrough and engages the rotating shade pin 30, so that said rotating shade pin 30 may be turned to extend or retract the shade screen 32 which is secured thereto.

When the sun shade 10 is not in use, it may be collapsed for convenient storage. As seen in FIG. 2, once the splint assemblies 20 are disengaged from the vertical and horizontal members 110 and 120 of the chair 100, the telescoping vertical arm assemblies may be shortened in length by inserting the inner tube 16B completely within the outer tube 16A. The entire telescoping vertical arm assembly 14 which, as mentioned earlier is pivotally secured to the horizontal cross member 12 at the upper end 14U, is pivoted about said upper end 14U to bring the telescoping vertical arm assembly 14 adjacent and parallel to the horizontal cross member 12 as depicted in FIG. 2. In addition, as mentioned earlier, the shade screen rails 34 are secured pivotally to the second side plates 26, so that they may be folded inward toward the rotating shade pin 30, as seen in FIG. 2, to further collapse the sun shade 10.

What is claimed is:

1. A sun shade for securing to a chair and providing shade therefor, comprising:

a) a rigid horizontal cross member having opposite ends;

b) a telescoping vertical arm assembly having an upper end and an opposite lower end, the upper end pivotally and slideably secured to each said end of the horizontal cross member;

c) a splint assembly, secured to the lower end of each said telescoping vertical arm assembly, having a vertical splint member for securing to a vertical member of the chair, and a horizontal splint member for securing to a horizontal member of the chair, and further having securing means comprising hook and loop fasteners secured to the vertical and horizontal splint members which respectively are adapted to engage the vertical member and horizontal member of the chair;

d) a first side plate secured to and extending upward from each said end of the horizontal cross member;

e) a second side plate secured to and extending outward horizontally from each said first side plate, and a stabilizing bracket extending between said second side plates parallel to the horizontal cross member;

f) a rotating shade pin rotateably secured between the second side plates;

g) a shade screen telescoping rail extending outward horizontally and parallel to each said second side plate; and h) a shade screen, secured to the rotating shade pin between the second side plates, capable of extending fully outward therefrom between the two shade screen rails and provide shade therebelow.

2. The sun shade of claim 1, wherein the telescoping vertical arm assemblies further comprise an outer tube having a smaller diameter inner tube extending therein, a height adjustment ring couples the outer tube and inner tube and permits the length of each said telescoping vertical arm assembly to be adjusted by varying the length of the inner tube which is contained within the outer tube, and hence permit the height of the entire sun shade to be adjusted with respect to the chair.

3. The sun shade of claim 2, wherein the shade screen rails which extend outward from the second side plate to frame the shade screen are pivotally secured to said second side plates, whereby upon non-use of the sun shade, it may be collapsed for storage by disengaging the splint assemblies from the chair, retracting the shade screen and winding it about the rotating shade pin, pushing inward the telescoping shade screen rail and folding them so that they are positioned adjacent and parallel to the rotating shade pin, and similarly folding inward the telescoping vertical arm assemblies so that they are positioned adjacent to the horizontal cross member of the sun shade.

* * * * *